United States Patent [19]

Ochiai

[11] Patent Number: 4,844,543

[45] Date of Patent: Jul. 4, 1989

[54] ROTATION MECHANISM FOR ROTATABLE SEAT

[75] Inventor: Susumu Ochiai, Akishima, Japan

[73] Assignee: Tachi-S Co., Ltd., Tokyo, Japan

[21] Appl. No.: 166,534

[22] Filed: Mar. 10, 1988

[51] Int. Cl.[4] ..... A47C 3/18; B60N 1/02

[52] U.S. Cl. ..... 297/349; 248/425; 296/65.1; 297/232; 297/344

[58] Field of Search ..... 297/344, 346, 349; 248/416, 425; 296/65 R

[56] References Cited

U.S. PATENT DOCUMENTS

| | | | |
|---|---|---|---|
| 2,201,839 | 5/1940 | Van Hoesen | 248/425 |
| 2,372,495 | 3/1945 | Horner et al. | 248/425 |
| 2,472,349 | 6/1949 | Smith | 248/425 |
| 4,417,715 | 11/1983 | Edwards | 297/349 X |

FOREIGN PATENT DOCUMENTS

| | | | |
|---|---|---|---|
| 22562 | 2/1980 | Japan | 297/349 |
| 56-131433 | 10/1981 | Japan . | |
| 61-20451 | 3/1983 | Japan . | |

*Primary Examiner*—Peter R. Brown

*Attorney, Agent, or Firm*—Browdy and Neimark

[57] ABSTRACT

A rotation mechanism for a rotatable seat, in which four rollers are arranged at the seat such that they are disposed equidistant at 90-degree angle from one another, and a substantially isosceles triangle shaped guide member is provided at the floor side of a vehicle such that its vertex extends towards the window-side wall of the vehicle. One of the four rollers is in a rolling contact with the vertex of the guide member when the seat is set in a normal seating position. Thus, with a small rotative force, the seat can be rotated without contact with the windowside wall of the vehicle so as to orient the seat towards a desired seating direction.

11 Claims, 4 Drawing Sheets

ROTATION MECHANISM FOR ROTATABLE SEAT

BACKGROUND OF THE INVENTION

1. Field of the Invention

The present invention relates to a rotation mechanism adapted to permit selective orienting adjustments of a rotatable seat provided in a vehicle such as a bus for orienting the seat towards a desired direction.

2. Description of the Prior Art

Various rotatable seats for use in a vehicle seat have been known, and also a variety of rotation mechanisms therefor have been devised and proposed.

As to the hitherto rotation mechanisms of this kind, the structure thereof is, by way of example, such that a sliding frame bearing a seat is slidably supported by a slide rail assembly fixed on the floor of a vehicle for transverse sliding movement relative to the vehicle body and is further provided with a rotation disc in a rotatable manner, on which rotation disc, a frame of the seat is fixed, and that the rotation disc is at its rear side connected with a displacing means having a plurality of rollers which are in rolling contact with a cam provided on the slide rail assembly. The movement of the displacing means along the cam causes the seat to rotate and move laterally of the vehicle, simultaneously, for changing the orientation of the seat.

This is disclosed from the Japanese Patent Publication No. 61-20451 and the Japanese Laid-Open Publication No. 56-131433, for instance.

However, those prior arts have been found disadvantageous in that the rotation of the seat for its orientation change requires a large labor and force on the part of an occupant sitting thereon and in most cases it is not easy or quite difficult for him or her to change the seat direction. With regard to the former Japanese prior art (61-20451), the displacing means are described as being a cross-shaped rotary cam with its four projecting ends being formed in a T-shaped configuration and two rollers are provided in an opposedly spaced manner so that each of them is located at a point to hinder the projecting ends of the cam, and consequently, the change of the seat direction requires a large operating force on the part of the occupant sufficient to rotate the seat in order for the T-shaped ends of the rotary cam to ride over the rollers. The same goes for the latter Japanese prior art (56-131433), in which the displacing means described as a roller and a triangle-shaped cam, is provided such that the roller is in rolling contact therewith, thus resulting in the necessity for the occupant to rotate the seat with a large force so as to cause the roller to roll over the vertex of the triangle-shaped cam.

SUMMARY OF THE INVENTION

With the above drawbacks in view, it is therefore a purpose of the present invention to provide an improved rotation mechanism for a rotatable seat, which is easily operated with a small operating force so as to effect the rotative change of the seat direction.

In accomplishment of this purpose, according the present invention, a displacing means includes four rollers so arranged that they are disposed equidistant at a 90-degree angle from one another and connected with a rotation disc rotatably provided on an upper frame of the seat. A guide cam member of a substantially isosceles triangle shape is provided on a lower frame of the seat with its vertex being directed towards the window of vehicle, in such a manner that one of the four rollers is normally in rolling contact with the vertex of the guide cam member. The upper and lower frames of the seat are slidably connected with each other via a slide rail assembly.

Accordingly, when the seat is oriented in a normal seating direction, one of the four rollers forming the displacing means is in rolling contact with the vertex of the substantially isosceles-triangle shaped guide cam member, and the application of a small rotative force to the seat will cause the downwardly rolling of the roller from the vertex of the guide cam member along its slope, so that the seat is rotated and moved, simultaneously, in a direction towards the aisle side. With this construction, the seat can be rotated easily with far reduced amount of operating force until it is oriented in the desired seating direction.

In one aspect of the present invention, the substantially isosceles-triangle shaped guide cam member is so formed that its both oblique sides are concavely curved, so that the rolling movement of the roller along such guide cam member causes the seat to rotate and move in a direction farther away from the window side of the vehicle towards the aisle side thereof. Accordingly, the seating direction of the seat can be changed without contact with the window side wall of the vehicle in a positive way.

DETAILED DESCRIPTION OF PREFERRED EMBODIMENTS OF THE INVENTION

Figure 1:
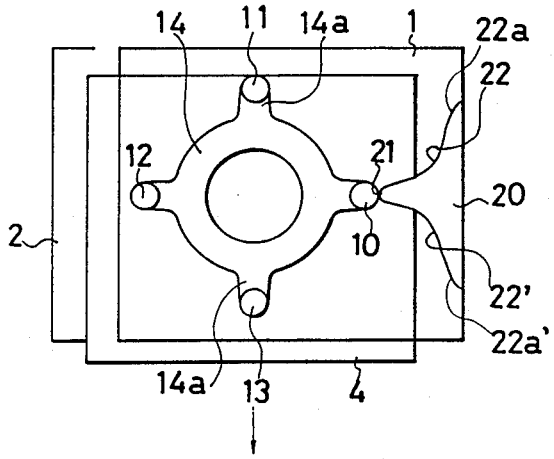
FIG. 1 is a plan view of a principal part of the present invention, showing the state where a displacing means is in a contact with the vertex of a guide cam member, which indicates a given normal seating direction of the seat.

Referring to FIGS. 1 through 6, a rotation mechanism is illustrated in accordance with the present invention, which is adapted for rotative direction changes of a rotatable seat.

First, with particular reference to FIGS. 3(A) through 5, description will be made of the construction of rotatable seats (A)(A'). Designations (a), (a') and (b), (b') denote seat cushions and seat backs, respectively, of the rotatable seats (A)(A') commonly used with a bus or the like. Each of the seats (A)(A') has an upper frame (4) on which the seat cushions (a)(a') are mounted, and a lower frame (1) fixed to the floor (e) of a vehicle, with a slide frame (2) interposed between the upper and lower frames (4) and (1). The slide frame (2) is fixed on an upper rail (5*a*) of a slide rail assembly (5) in which the upper rail (5*a*) is slidably fitted to a lower rail (5*b*), thus permitting the slide frame (2) and the upper frame (4) fixed thereto to be slidingly movable relative to the lower frame (1) in its longitudinal direction.

The seats (A)(A') are also arranged in a rotatable manner by means of an annular rotation member (3) which is rotatably mounted on the slide frame (2) and, at its upper portion, fixed to the upper frame (4). The annular rotation member (3) is a part of a commonly known rotation device to be described later.

With the above-described structure, each of the seats (A)(A') can be moved in a direction transversely of a vehicle body (B) while at the same time can be rotated about the annular rotation member (3).

Figure 5:
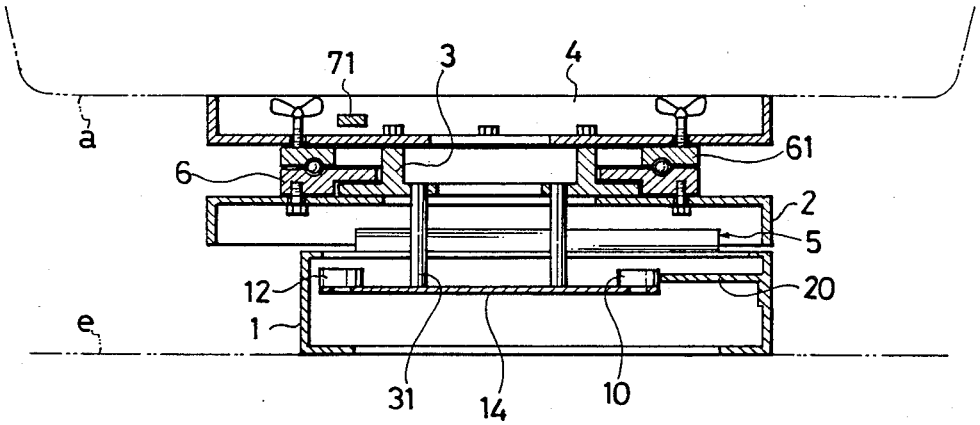
FIG. 5 is a sectional view of the same rotation device as in the FIG. 4.
Figure 3:
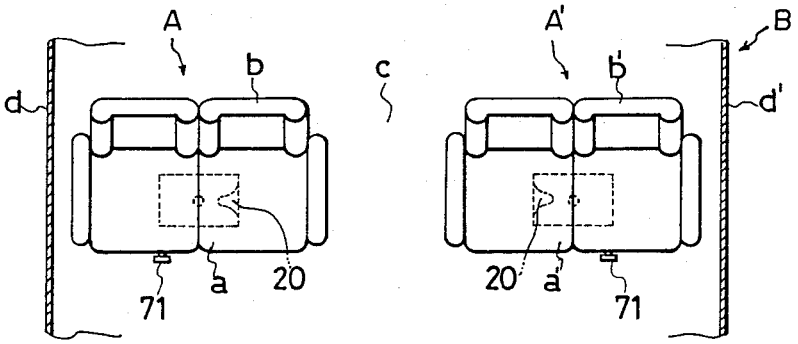
FIG. 3(A) is a plan view which shows that a pair of seats are arranged in a vehicle in the normal seating direction, when the displacing means and guide cam member are in contact with each other as in the FIG. 1.
FIG. 3(B) is a plan view which shows the seats rotated from the normal seating state as in FIG. 3(A) to 45-degree angle position, when the displacing means is rotated and moved as in the FIG. 2.
Figure 3:
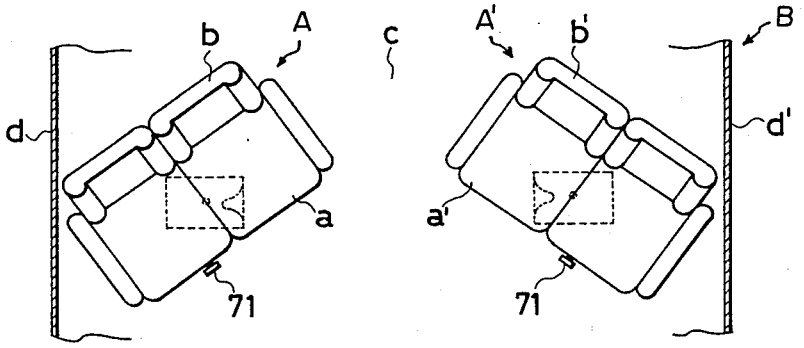
Figure 6:
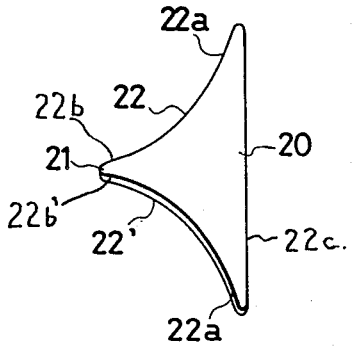
FIG. 6 is a perspective view of one embodiment of the guide cam member.

As shown in FIGS. 5 and 6, four rollers (10)(11)(12)(13) are rotatably arranged at the respective projections (14*a*) formed integrally with an annular rotation plate (14) such that the rollers (10)(11)(12)(13) are disposed equidistant at 90-degree angles from one another. A guide cam member (20) having a substantially isosceles triangle shape is fixed on the lateral bar section of the lower frame (1) which faces the aisle side (c) of the vehicle body (B), with the vertex (21) of the guide cam member (20) extending inwardly if the lower frame (1) towards the window-side wall (d). The four rollers (10)(11)(12)(13), in a rolling contact with the guide cam member (20), act as a displacing means for rotatively displacing the seats (A)(A'), which will be explained in detail hereinafter.

Figure 2:
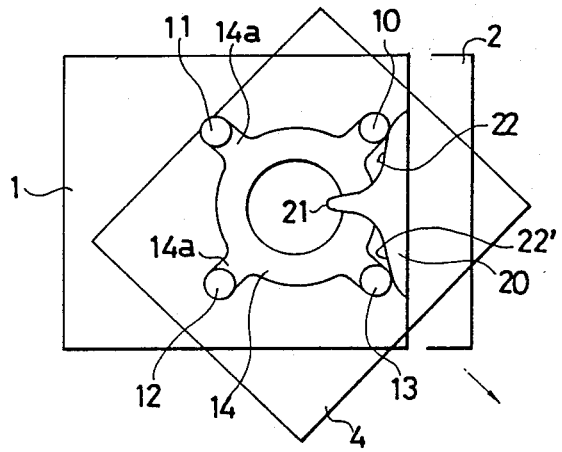
FIG. 2 is a plan view of the same principal part as in FIG. 1, which shows the state where the displacing means is rotated and moved along the guide cam member, when the seat is rotated at 45-degree angle.
Figure 4:
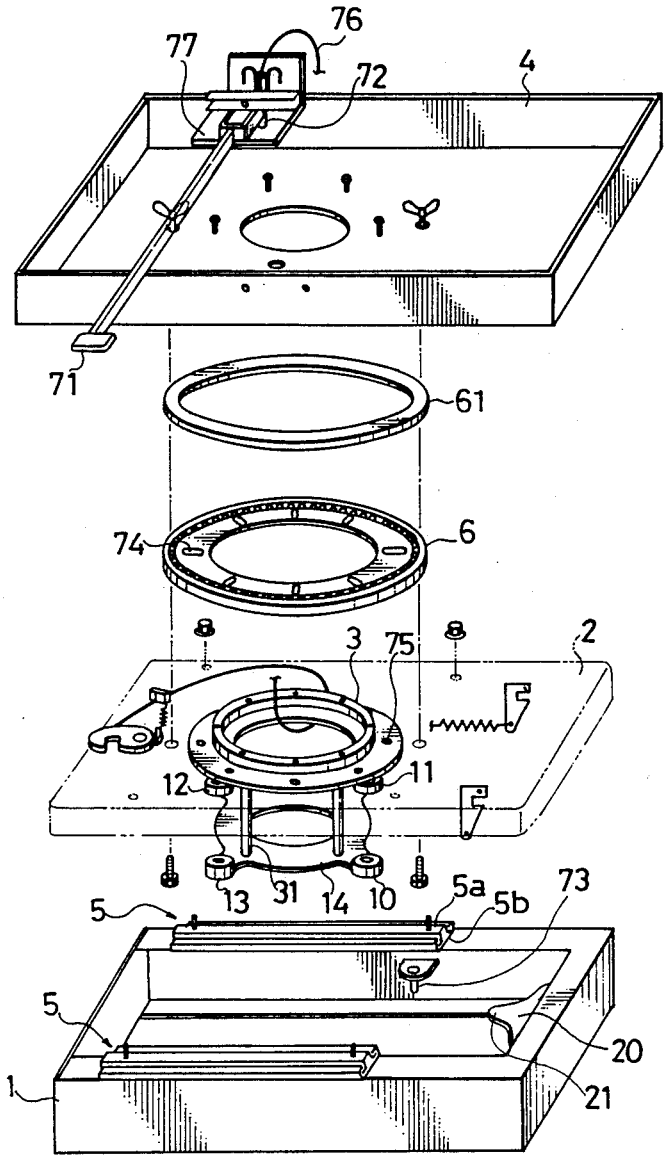
FIG. 4 is an exploded perspective view of a rotation device provided with the principal part of the present invention.

FIGS. 1 and 2 schematically illustrate the interaction and relationship between the four rollers (10)(11)(12)(13) and the guide cam member (20). Specifically, when the seat (A) is set in a normal seating direction as shown in FIG. 3(A), towards a forward operating direction of the vehicle, one of the four rollers, designated by (10), as in FIG. 1, is contact with the vertex (21) of the substantially isosceles-triangle shaped guide cam member (20). Such contact of the roller (10) with the guide cam member (20) is retained by a locking device including elements (71, 72, 73, 74, 75, 76, 77) which is best shown in FIG. 4, and will be described later. The arrow in FIG. 1 stands for the normal seating direction of the seat (A). Then, when the seat (A) is rotated from the normal seating direction, as in FIG. 3(A), to an angle of 45 degrees towards the aisle side (c), after being released from its locked state by operating the locking device, the roller (10) is rolled down from the vertex (21) of the guide cam member (20) along the first oblique side (22) thereof to stop at the foot portion (22*a*) of that first side (22). Another roller (13) is transferred to contact the foot portion (22*a*') of the second oblique side (22') of the same member (20) disposed in an opposed relationship with the first oblique side (22) relative to the vertex (21). This causes the seat (A) to rotate at a 45-degree angle and simultaneously move in a direction away from the window-side wall (d) towards the aisle side (c), as shown in FIG. 2. The arrow in FIG. 2 stands for the 45-degree-angle rotated state of the seat (A), which is indicative of the first rotation stage thereof.

Figure 7:
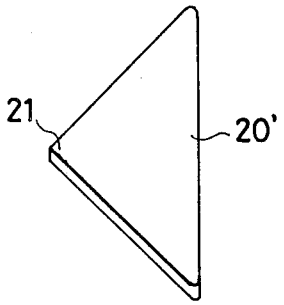
FIG. 7 is a perspective view of another embodiment of the guide cam member.

As best shown in FIG. 6, the substantially isosceles-triangle guide cam member (20) is formed such that its first and second oblique sides (22)(22') diverge downwardly from its vertex (21) in a concavely curved sense, with their respective upper areas (22*b*) (22*b*') in the vicinity of the vertex (21) assuming a steep slope. The respective foot portions (22*a*)(22*a*') of those first and second oblique sides (22)(22') are gently sloped down to the base (22*c*) of the guide cam member (10). Accordingly, it is seen that the steeply sloped upper areas (22*b*)(22*b*') approximates the direction wherein the seat (A) is moved transversely of the vehicle body (B), namely, the direction wherein the seat (A) is to be moved towards and from the aisle side (c). Therefore, the roller (10), when rolled down along the upper area (22*b*') of the second oblique side (22'), is moved in a substantially straight-line direction towards the aisle side (c). This means that the roller (10) is moved in a direction more oriented towards the aisle side (c) than would be the case if the second oblique side (22') (also the first one (22)) is merely formed in a rectilinear shape as shown in FIG. 7. With the cam shown in FIG. 7, the seat (A), at the time when rotation begins is moved farther towards the aisle side (c) away from the window-side wall (d), thereby positively avoiding the undesired contact of the seat (A) or its arm rest with the window-side wall (d) during the initial rotation thereof.

Further, the gentle slope of the foot portions (22*a*)(22*a*') of the first and second oblique sides (22)(22') respectively, makes it easy for another roller (11) to roll upwardly from the former foot portion (22*a*) towards the vertex (21) at the second stage of rotating the seat (A) an additional 45-degree angle. At this point, the seat (A) is rotated at a 90-degree angle from the normal direction stated above. This also makes it easy for the roller (10) to return to the vertex (21) from the latter foot portion (22*a*'). Hence, with a small force, the seat (A) can be rotated easily to change its seating direction, or rotated back to its normal seating direction.

FIG. 7 shows another guide cam member (20') whose both oblique sides are formed having a rectilinear shape, with the point of the vertex (21) being sharp, representing a genuine isosceles triangle shape, as opposed to the above-described guide cam member (20). In this embodiment, the rollers (10)(11)(12)(13) are preferably formed smaller in diameter, which advantageously reduces the distance between the roller (10) and the vertex (21) of the guide cam member (20') when the former is in contact with the latter as the case with FIG. 1. This results in that the clearance between the window-side (d) and the seat (A) is also reduced, thus providing an increased space in the aisle side (c). Moreover, due to the small diameter, the roller (10) is situated closer to the aisle side (c) and rolled down quickly and ahead relative to the one whose diameter is large, whereby the seat (A) is moved much far towards the aisle side (c) during its initial rotation.

Referring to FIGS. 4 and 5, description will now be given regarding a rotation device for allowing the annular rotation plate (14) and seat (A) to be rotatable. In addition to the aforementioned annular rotation member (3), the rotation device comprises an upper ring member (61) fixed to the upper frame (4) of the seat (A), and a lower ring member (6) fixed on the slide frame (2) such as to be in a rotatable contact with the upper ring member (61). Between the lower ring member (6) and slide frame (2), the annular rotation member (3) is rotatably supported to which the annular rotation plate (14) is connected by means of connecting rods (31).

Although not shown, the slide frame (2) is biased in a direction towards the aisle side (c) by means of a spring member extended between the slide frame (2) and the lower rail (1) in order to facilitate the rotation and movement of the seat (A) as described above.

To lock and unlock the sliding movement of the slide frame (2) and the rotation of the annular rotation member (3), a suitable known locking device is provided for each of them, and therefore a specific description is omitted thereon. However, to briefly describe, those locking devices comprises an operation lever (71), a lock pin (73) fixed on the lower frame (1), a stopper pin (72) operatively connected with the operation lever (71), a plurality of holes (74) perforated in the lower ring member (6), a plurality of engagement holes (75) formed in the annular rotation member (3), a cable (76) for operatively connecting the lever (71) with the lock pin (73), and a bracket (77) which supports the lever (71).

Now, the operation of the present invention will be described together with the above-described locking device as below.

When the seat (A) is set in the normal seating direction as above, the operation of the lever (71) causes the disengagement of the stopper pin (72) from one of the holes (74) as well as from one of the engagement holes (75) to thereby allow the seat (A) to be rotated. This simultaneously actuates the lock pin (73) via the cable (76) to release the slide frame (2) from its locked state relative to the lower frame (1), to thereby allow the seat (A) to be movable transversely of the vehicle body (B) via the slide rail assembly (5). Under this condition, when a small force is applied to the seat (A) by an occupant who will sit thereon, the annular rotation plate (14) and four rollers (10)(11)(12)(13) are rotatively displaced along the guide cam member (20) (or other guide cam member (20')) from the above-described normal seating direction as shown in FIG. 1 to the 45-degree-angle rotated state as in FIG. 2. Namely, as previously described, the roller (10) is rolled down from the vertex (21) of the guide cam member (20) or (20') along its one oblique side to stop at its one foot portion, while another roller (13) is brought to contact with the other foot protion of the guide cam member (20) or (20'). With this rotative displacement of the rollers (10)(11)(12)(13), the seat (A) is rotated and moved towards the aisle side (c) without contact with the window-side wall (d), after which, the stopper pin (72) and lock pin (73) are actuated to bring into a locked state the respective rotation device and slide rail assembly (5), automatically, by means of a spring (not shown).

Subsequently, the repetition of the above-mentioned rotation step causes the full 180-degree-angle rotation of the seat (A) so as to completely orient the same towards its reverse direction, or causes the rotation of the seat (A) in a desired angle of seating direction.

The above-mentioned operations for the seat (A) are carried out in the same way with regard to another seat (A'). Description in this respect is therefore omitted.

From the description above, the present invention is endowed with the following advantageous effects.

(1) The rotation of the seat can be effected by a slight or small force of an occupant sitting on the seat, towards a desired seating direction.

(2) The mere provision of the substantially isosceles-triangle shaped guide cam member simplifies the structure of and reduces the weight of the rotation mechanism per se in comparison with aforementioned prior arts.

(3) The concavely curved oblique sides of the guide member permits the rollers to move therealong in a substantially straight-line direction towards the aisle side at the initial rotation of the seat, and as such, the seat is moved far towards the aisle side during its initial rotation, which insures to avoid the contact of the seat or its peripheral portion with the window-side wall.

While the description has been given of preferred embodiments of the present invention, it should be understood that the invention is not limited to the illustrated embodiments, but various other replacements, modifications and additions may structurally be possible without departing from the scope and spirit of the appended claims for the invention.

What is claimed is:

1. A rotation mechanism for a rotatable seat in which said seat includes a seat cushion, an upper frame fixed to the seat cushion, and a lower frame fixed to a floor of a vehicle, said rotation mechanism comprising a slide frame slidably supported on said lower frame in a manner slidingly movable in a direction transversely of a longitudinal centerline of said vehicle, a rotation member rotatably provided on said slide frame, said rotation member being connected to said upper frame, a guide member provided on said lower frame, and a displacing means connected to an underside of said rotation member, said displacing means being movable along said guide member, wherein, said displacing means comprises four rollers so arranged that they are disposed equidistant at 90-degree angle from one another;

wherein, said guide member is of a substantially isosceles triangle shape, and provided on a lateral section of said lower frame closest to said longitudinal centerline of said vehicle in such a manner that a vertex of said guide member extends inwardly of said lower frame in a direction transversely from said longitudinal centerline of said vehicle; and wherein one of said four rollers is in a rollable contact with said vertex of said guide member when said seat is set in a position which is parallel or orthogonal with respect to the longitudinal centerline of said vehicle, with said seat cushion being oriented in a seating direction which is parallel or orthogonal with respect to the longitudinal centerline of the vehicle.

2. The rotation mechanism as defined in claim 1, wherein both oblique sides of said guide member are so formed that they diverge from said vertex in a concavely curved manner.

3. The rotation mechanism as defined in claim 2, wherein said guide member has a gently sloped foot portion in each of said oblique sides.

4. The rotation mechanism as defined in claim 1, wherein said guide member is of an isosceles triangle shape, of which both sides are formed rectilinear.

5. The rotation mechanism as defined in claim 1, wherein said guide member has a vertex whose point is formed sharp and wherein said four rollers are each small in diameter.

6. The rotation mechanism as defined in claim 1 further comprising means for maintaining one of said rollers in contact with said vertex of said guide member when the seat is in a position which is parallel or orthogonal to the longitudinal centerline of the vehicle.

7. A rotation mechanism for a rotatable seat in which the seat includes a seat cushion, an upper frame fixed to the seat cushion, and a lower frame fixed to a floor of a vehicle, said rotation mechanism comprising;

a slide frame slidably supported on the lower frame in a manner slidingly movable in a direction transversely of a longitudinal centerline of the vehicle, a rotation member rotatably provided on the slide frame and connected to the upper frame, a guide member provided on the lower frame, and displacing means connected to an underside of said rotation member, said displacing means being movable along said guide member, and said displacing means comprising four rollers so arranged that they are disposed equidistant at a 90-degree angle from one another, said guide member having a substantially isosceles triangle shape, and provided on a lateral section of the lower frame closest to the longitudinal centerline of the vehicle, said guide member having a vertex extending inwardly of the lower frame in a direction transverse to the longitudinal centerline of the vehicle and two guide surfaces guiding said rollers, and means for maintaining one of said four rollers in rollable contact with said vertex of said guide member when the seat is set in a position which is parallel with or orthogonal to the longitudinal centerline of the vehicle.

8. The rotation mechanism as defined in claim 7, wherein both guide surfaces of said guide member are so formed that they diverge from said vertex in a concavely curved manner.

9. The rotation mechanism as defined in claim 8, wherein said guide member has a gently sloped foot portion in each of said guide surfaces.

10. The rotation mechanism as defined in claim 7, wherein said guide member is of an isosceles triangle shape, of which both guide surfaces are formed so as to be rectilinear.

11. The rotation mechanism as defined in claim 7, wherein said guide member has a vertex whose point is formed sharp and wherein said four rollers are each small in diameter.

* * * * *